United States Patent [19]

Hosoi et al.

[11] Patent Number: 4,761,358

[45] Date of Patent: Aug. 2, 1988

[54] ELECTROSTATOGRAPHIC ENCAPSULATED TONER

[75] Inventors: Noriyuki Hosoi; Akira Hatakeyama, both of Fujinomiya, Japan

[73] Assignee: Fuji Photo Film Co., Ltd., Kanagawa, Japan

[21] Appl. No.: 886,550

[22] Filed: Jul. 16, 1986

[30] Foreign Application Priority Data

| | | | |
|---|---|---|---|
| Jul. 16, 1985 | [JP] | Japan | 60-156526 |
| Nov. 2, 1985 | [JP] | Japan | 60-246807 |
| Mar. 28, 1986 | [JP] | Japan | 61-71873 |
| Mar. 28, 1986 | [JP] | Japan | 61-71874 |

[51] Int. Cl.[4] ..... G03G 9/08; G03G 9/14

[52] U.S. Cl. ..... 430/109; 430/138; 428/402.21; 428/402.22

[58] Field of Search ..... 430/109, 138; 428/402.21, 402.22

[56] References Cited

U.S. PATENT DOCUMENTS

| | | | |
|---|---|---|---|
| 4,497,885 | 2/1985 | Ushiyama et al. | 430/109 X |
| 4,520,091 | 5/1985 | Kakimi et al. | 430/109 X |
| 4,581,312 | 4/1986 | Hakahara et al. | 430/138 X |
| 4,599,289 | 7/1986 | Suematsu et al. | 430/138 X |

FOREIGN PATENT DOCUMENTS

| | | | |
|---|---|---|---|
| 58-174957 | 10/1983 | Japan | 430/109 |
| 58-176643 | 10/1983 | Japan | 430/109 |
| 58-176642 | 10/1983 | Japan | 430/109 |

*Primary Examiner*—Roland E. Martin

*Attorney, Agent, or Firm*—Jules E. Goldberg

[57] ABSTRACT

An electrostatographic encapsulated toner comprising a core material which comprises a colorant and a binder and a resin shell enclosing said core material in the form of micro-capsule, which is characterized in that:

said binder is an oily binder comprising a solid polymer and an organic solvent capable of dissolving or swelling said polymer and having a boiling point of not lower than 150° C., said oily binder having a viscosity within the range of 1,000–100,000 cp at 25° C.; said resin shell is formed around the core material by a polymerization process selected from the group consisting of an interfacial polymerization process, an inner polymerization process and an outer polymerization process; and the surface of said resin shell is deposited with a polymer of at least one vinyl monomer having a nitrogen-atom.

13 Claims, No Drawings

ELECTROSTATOGRAPHIC ENCAPSULATED TONER

BACKGROUND OF THE INVENTION

1. Field of the Invention

The present invention relates to an electrostatographic encapsulated toner employable for producing a visible image from a latent image in a recording method utilizing an electrostatography.

2. Description of Prior Arts

As the process for fixing a toner image in a recording method such as an electrostatography, there have been known three fixing processes, that is, a heat fixing process, a solvent fixing process and a pressure fixing process. Recently, the heat fixing process and the pressure fixing process, both using no solvent, are widely used from the viewpoint of the prevention of environmental pollution.

In the heat fixing process, a toner comprising a colorant bound with a binder has been conventionally employed. The same kind of toner is also employed in the pressure fixing process, but utilization of an encapsulated toner is recently proposed in the pressure fixing process.

The encapsulated toner is a toner in the form of micro-capsule prepared by enclosing a core material comprising a colorant such as carbon black and a binder with a resin shell which is rupturable by the application of pressure.

The conventional encapsulated toner is not necessarily satisfactory in various properties that are essentially required for a toner.

As a developing agent employable for the electrostatography, there has been conventionally employed a toner which has insulation properties on its surface, but recently a toner provided with an appropriately positive or negative friction-electrostatic chargiablity on the surface has been developed. This electrostatography comprises procedures of electrostatically charging a toner by rubbing the toner with carrier particles such as iron powder or furs, and causing a latent image to draw the electrostatically charged toner. Accordingly, the toner employable in the electrostatography is required to have positive or negative friction-electrostatic chargiablity corresponding to the negative or positive electrostatic charge of the latent image depending on the nature of an apparatus employed.

As a method for giving friction-electrostatic chargeability to the conventional toner, there is generally utilized a method of adding an electrostatic charge modifier to a toner in combination with a resin to disperse the electrostatic charge modifier inside the toner in the procedure of the preparation of a toner. However, as for an encapsulated toner, it is difficult to effectively fix the electrostatic charge modifier onto the surface of encapsulated toner, and accordingly a powdery electrostatic charge modifier such as silica powder is generally deposited onto the surface of the encapsulated toner so as to give the friction-electrostatic chargeability to the encapsulated toner.

However, the present inventor has found that in the encapsulated toner deposited with an electrostatic charge modifier such as silica powder on its surface, the electrostatic charge modifier easily separates or drops off from the encapsulated toner when the encapsulated toner is stored or employed for a long period of time. In the case that a relatively large amount of the electrostatic charge modifier separates or drops off from the encapsulated toner, the encapsulated toner tends to be insufficient in the developing properties so as to cause unfavorable effect on the image characteristics of the resulting visible image such as lowering of sharpness or density. The encapsulated toner is also needed to be excellent in other various properties such as powder flowability and preservation stability than the above-mentioned friction-electrostatic chargeability. If any one of those properties is deteriorated, the resulting visible image having high image quality can be hardly obtained.

For providing a positive friction-electrostatic charge to an encapsulated toner, there has been proposed a method of forming a resin shell from polymers obtained from nitrogen-containing monomers such as N-vinyl compounds, vinyl imidazole or derivatives thereof, vinyl pyridine or derivatives thereof, acrylamide or derivatives thereof, compounds containing other vinyl group or amino group, and quaternary ammonium salts of those compounds or derivatives, as described in Japanese Patent Provisional Publications No. 59(1984)-185353, No. 59(1984)-187350, No. 59(1984)-187352, No. 59(1984)-187355, No. 59(1984)-187357, No. 59(1984)-189354, No. 59(1984)-189355.

The above-mentioned publications describe the use of a solid binder such as a polymer easily interlocking with fibers of ordinary papers, for instance, polyethylene or a paraffin wax, as a binder employable for the encapsulated toner.

However, it has been confirmed by the present invention that while the encapsulated toner comprising a resin shell of the above-mentioned polymers of the nitrogen-containing monomers and the solid binder such as a polymer or a paraffin wax is favorable in the friction-electrostatic positive chargeability, such toner is insufficient in the pressure fixability. Accordingly, the employment of such encapsulated toner in the electrostatography utilizing a pressure fixing process requires very high pressure for the fixing, and such a high pressure causes various problems such as requirement of a great-size apparatus, occurrence of fatigue of paper sheets employed for receiving the toner image, and occurrence of glossy surface on the paper sheet. Further, in the case of using such toner containing the solid binder, on the surface of a paper sheet having a toner image fixed thereon are placed a relatively large amount of toner particles in the protruded form, and hence the toner image tends to be moved or stained by mechanical shock such as friction between the paper sheet having the toner image thereon and other paper sheets or fingers.

An oily composition comprising a solid polymer and a high-boiling organic solvent capable of dissolving or swelling the solid polymer (e.g., solvent having a boiling point of not lower than 150° C.) is also known as a binder of an encapsulated toner employable in the pressure fixing process. Accordingly, it can be presumed that the combination of the aforementioned resin shell having excellent friction-electrostatic chargeability of positive charge and the above-mentioned oily binder is utilized. However, it is very difficult to densely form a resin shell of the aforementioned polymer which has a nitrogen-containing monomer as a main monomer component around the oily binder.

SUMMARY OF THE INVENTION

It is an object of the present invention to provide a novel encapsulated toner employable in an electrostatography.

It is another object of the present invention to provide an encapsulated toner employable in an electrostatography which is improved in stability of friction-electrostatic positive chargeability and shows high flowability and preservation stability as well as high fixability.

It is another object of the present invention to provide an encapsulated toner employable in an electrostatography which is improved in stability of friction-electrostatic negative chargeability and shows high flowability and preservation stability as well as high fixability.

The encapsulated toner of the invention is an electrostatographic encapsulated toner comprising a core material which comprises a colorant and a binder and a resin shell enclosing said core material in the form of micro-capsule, which is characterized in that:

said binder is an oily binder comprising a solid polymer and an organic solvent capable of dissolving or swelling said polymer and having a boiling point of not lower than 150° C., said oily binder having a viscosity within the range of 1,000–100,000 cp at 25° C.; and the surface of said resin shell is deposited with a polymer of at least one vinyl monomer having a nitrogen atom.

The encapsulated toner of the invention less produces separation of an electrostatic charge modifier from the toner even in the case that the toner is employed for long period of time, as compared with the conventional encapsulated toner provided with an electrostatic charge modifier which has a positive or negative electrostatically-charging function such as metal-containing dye or silica powder thereon, because on the surface of the encapsulated toner of the invention is deposited with a polymer derived from a monomer which has an electrostatic charge modifying function, that is, a positive or negative electrostatically-charging function. For this reason, even if the encapsulated toner of the invention is employed for a long period time, the friction-electrostatic chargeability less varies, and an excellent visible image can be constantly obtained. In addition, the resulting image has high sharpness owing to the high flowability of the encapsulated toner.

Further, since the encapsulated toner of the invention has high preservation stability, there can be given an excellent visible image even after the long period of time in the storage.

Furthermore, the encapsulated toner of the invention shows high fixability in the electrostatographic process employing a pressure fixing. In more detail, when the encapsulated toner is ruptured on a paper sheet in the pressure fixing process, an organic solvent first wets inside of the paper to accelerate permeation of a solid polymer binder and a colorant into the paper sheet in a short time, and the solid polymer binder and the colorant are introduced inside the paper sheet. Then, the organic solvent evaporates, and the colorant is kept firmly inside the paper sheet by the solid polymer binder. As a result, the fixing of toner is performed reliabley at a relatively low pressure, whereby the apparatus employed in the electrostatographic process can be made smaller, and the fatigue of the paper sheet for accepting the toner image decreases. In the case of using a solid polymer or a solid binder such as wax alone (namely, in the conventional case), the colorant and the solid binder permeate the paper sheet insufficiently, and a relatively large amount thereof remains on the surface of the paper sheet in the protruded form. As a result, there arise various problems such as transferring of toner material to other paper sheets (i.e., toner staining) when the paper sheet having a toner image is superposed on other paper sheet, or staining of a duplicated image by the contact with fingers or other materials. In contrast, in the case of using the encapsulated toner utilizing an oily binder according to the invention, the colorant is firmly kept inside the paper sheet owing to the solid polymer binder as described above, so that the toner staining or staining of the duplicated image rarely occurs.

DETAILED DESCRIPTION OF THE INVENTION

The encapsulated toner of the present invention can be prepared by the process described below.

In the first place, a resin shell is formed around a droplet containing a colorant and a binder component in an aqueous medium by means of an interfacial polymerization process, an inner polymerization process, or an outer polymerization process to produce a micro-capsule. This process for the preparation of micro-capsules is generally known. Thus, the conventional method and known materials for the preparation of micro-capsules can be employed in the invention.

Examples of the solid polymer employable for the use as the binder of the encapsulated toner of the invention include polyolefin, olefin copolymer, styrene resin, styrene-butadiene copolymer, epoxy resin, polyester, rubbers, polyvinylpyrrolidone, polyamide, coumarone-indene copolymer, methyl vinyl ether-maleic anhydride copolymer, amino resin, polyurethane, polyurea, homopolymers and copolymers of acrylic acid ester, homopolymers or copolymers of methacrylic acid ester, acrylic acid-long chain alkyl methacrylate copolymer oligomer, polyvinyl acetate, and polyvinyl chloride.

Among those polymers, preferably employed are homopolymers and copolymers of acrylic acid esters, homopolymers or copolymers of methacrylic esters and styrene-butadiene copolymers.

The organic solvent employable for the binder is a high-boiling solvent capable of dissolving or swelling the above-described polymer and having a boiling point of not lower than 150° C. (also referred to simply as a high-boiling solvent).

Examples of the high-boiling solvent are as follows: phthalic acid esters such as diethyl phthalate, and dibutyl phthalate; aliphatic dicarboxylic acid esters such as diethyl malonate and dimethyl oxalate; phosphoric acid esters such as tricresyl phosphate and trixylyl phosphate; citric acid esters such as O-acetyl triethyl citrate and tributyl citrate; benzoic acid esters such as butyl benzoate and hexyl benzoate; aliphatic acid esters such as hexadecyl myrestate and dioctyl adipate; alkylnaphthalenes such as methylnaphthalene, dimethylnaphthalene, monoisopropylnaphthalene and diisopropylnaphthalene; dialkylphenyl ethers such as di-o-methylphenyl ether, di-m-methylphenyl ether and di-p-methylphenyl ether; amides of higher fatty acids or aromatic sulfonic acids such as N,N-dimethyllauroamide and N-butylbenzenesulfonamide; trimelitic acid esters such as trioctyl trimellitate; and diarylalkanes such as diarylmethanes (e.g., dimethylphenylphenylmethane) and diarylethanes (e.g., 1-phenyl-1-methylphenylethane, 1-dimethylphenyl-1-phenylethane and 1-ethylphenyl-1-phenylethane).

Preferably employable as the high-boiling solvent for the binder of the encapsulated toner of the invention are high-boiling solvents of non-ester type, particularly alkylnaphtahlene, diphenylalkyl ether and diarylalkane, which give unfavorable effect (e.g., dissolving or deteriorating the resinous shell) of an extremely low level to the resin shell.

The binder of the encapsulated toner of the invention preferably comprises a combination of the above-described solid polymer and high-boiling solvent. The ratio between the solid polymer and the high-boiling solvent is generally within the range of 1:0.2 to 1:20 (binder: high-boiling solvent, by weight), preferably 1:0.5 to 1:10, more preferably 1:1 to 1:10. The oily binder should be an oily liquid of high viscosity generally having a viscosity within the range of 1,000 to 100,000 cp at 25° C., preferably within the range of 5,000 to 40,000 cp at 25° C.

The binder comprising a combination of the solid polymer and the high-boiling solvent employable for the encapsulated toner of the invention is desired to further contain an organic solvent substantially not dissolving or swelling the solid polymer and having a boiling point of 100°-250° C. (also referred to simply as an non-solvent organic liquid). Examples of the non-solvent organic liquid include saturated aliphatic hydrocarbons and organic liquid mixtures mainly containing saturated aliphatic hydrocarbons.

As a colorant contained in a conventional toner for the electrostatography, generally employed are a black toner such as carbon black or graft carbon black and a chromatic toner such as a blue, red or a yellow colorant. In the encapsulated toner of the invention, those colorants can be also employed.

The core material of the encapsulated toner of the invention may further contain magnetizable particles (particulate material capable of being magnetized). As the magnetizable particles, there can be mentioned magnetizable particles employable for a conventional magnetic toner. Examples of the magnetizable particles include particles of metals (e.g., cobalt, iron and nickel), alloys and metallic compounds. In the case of using a chromatic magnetizable powder such as a powder of black magnetite, the chromatic magnetizable powder can serve as both of a magnetizable particle and a colorant.

There is no specific limitation on the resin employable for producing a shell of the encapsulated toner, as far as the resin can form a dense shell around a droplet comprising a core material through any one of an interfacial polymerization, inner polymerization and an outer polymerization. From the viewpoint of various properties as an encapsulated toner suitable for a pressure fixing process, preferred are polyurea, polyurethane, polyamide, polyester and epoxy resin. These resins can be employed singly or in combination. From the viewpoint of the strength and flexibility of the shell, the shell material of the invention preferably is a polyurea resin, a polyurethane resin or a mixture of polyurea resin and polyurethane resin.

The process for the preparation of the encapsulated toner of the invention will be described below in more detail by referring to a process for the preparation of an encapsulated toner comprising a shell of polyurethane resin or polyurea resin.

There have been heretofore known various methods for producing micro-capsules by forming a shell of polyurea and/or polyurethane resin around a core material in the form of droplet containing a colorant and a binder (and magnetizable particles, if desired) in an aqueous liquid. Those methods can be employed for the preparation of the encapsulated toner of the present invention.

For instance, an interfacial polymerization can be mentioned as a method of utilizing polymerization reaction for producing micro-capsules. Other methods such as inner polymerization and outer polymerization, both of which also utilize the polymerization reaction for the preparation of micro-capsules, can be employed in the present invention.

A shell of polyurea resin and/or polyurethane resin is easily prepared as a shell of micro-capsules by subjecting polyisocyanate (e.g., diisocyanate, triisocyanate, tetraisocyanate and polyisocyanate prepolymer) to the interfacial polymerization reaction with polyamine (e.g., diamine, triamine and tetraamine), prepolymer having two or more amine groups, piperazine and derivatives thereof, or polyol in an aqueous medium.

The micro-capsule having a shell produced as above is then washed with water.

The encapsulated toner of the invention can be prepared by deposition of a polymer derived from at least one of vinyl monomers having a nitrogen-atom.

The vinyl monomer having a nitrogen-atom preferably is one of the compounds having the following formulas (I)-(IV):

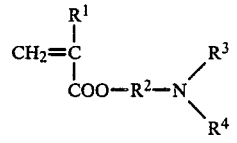
(I)

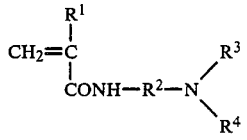
(II)

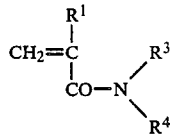
(III)

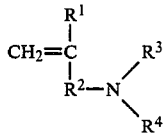
(IV)

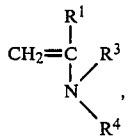
(V)

in which $R^1$ is the hydrogen atom or an alkyl group having 1-4 carbon atoms; $R^2$ is one selected from the group consisting of an alkylene group having 1-8 carbon atoms, an alkylene oxyalkylene group having 1-8 carbon atoms, a phenylene group, a naphthylene group and a group having a combination of two or more those groups; $R^3$ and $R^4$ are the same as or different from each other, and each of $R^3$ and $R^4$ is the hydrogen atom or a group selected from the group consisting of an alkyl group having 1–8 carbon atoms, a phenyl group, a naphthyl group and a phenylalkyl group having an alkyl group of 1–4 carbon atoms.

Further, the vinyl monomer having a nitrogen-atom preferably is one of the compounds having the following formulas (VII) and (VIII):

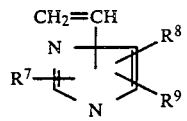

(VII)

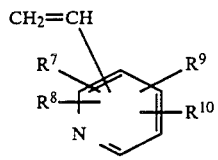

(VIII)

in which $R^7$, $R^8$, $R^9$ and $R^{10}$ are the same as or different from each other and each is the hydrogen atom or an alkyl group having 1–10 carbon atoms.

Furthermore, the vinyl monomer having a nitrogen-atom preferably is a compound having the following formula (IX):

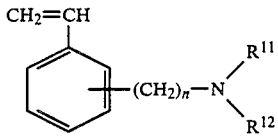

(IX)

in which $R^{11}$ and $R^{12}$ are the same as or different from each other and each is the hydrogen atom or a group selected from the group consisting of an alkyl group having 1–10 carbon atoms, a phenyl group, a naphthyl group and a phenylalkyl group having 1–4 carbon atoms in the alkyl chain; and n is an integer of 1 to 4.

The vinyl monomer having one of the above-given formulas (I) to (V) and (VII) to (IX) is a vinyl monomer having an electron-donating group. The deposition of a polymer of a vinyl monomer having an electron-donating group on the shell surface of a toner imparts to the toner a positive chargeability.

The vinyl monomer having one of the above-given formulas (I) to (V) and (VII) to (IX), particularly the vinyl monomer having the formulas (I) to (V), can be advantageously copolymerized with other vinyl polymer having the formula (VI):

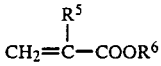

(VI)

wherein $R^5$ is the hydrogen atom or an alkyl group having 1–4 carbon atoms, and $R^6$ is the hydrogen atom or a group selected from the group consisting of an alkyl group having 1–8 carbon atoms, a phenyl group, a naphthyl group and a phenylalkyl group having an alkyl group of 1–4 carbon atoms to give a polymer favorably employable for deposition on a shell surface of a toner. Preferred molar ratio of the monomer having one of the formulas (I) to (V) and (VII) to (IX) to the monomer of the formula (VI) used in the preparation of the copolymer ranges from 0.1:10 to 10:10.

The deposition of the above-mentioned copolymer on the toner surface is advantageous because it can easily impart to the toner an increased positive chargeability.

If a negative chargeability should be imparted to a toner, a preferred monomer is acrylonitrile which has an electron-atractive nitrile group.

The vinyl monomer having a nitrogen atom is preferably graft-polymerized on the surface of the shell. The graft-polymerization is preferably performed on the shell surface in the presence of a tetravalent cerium compound. Such polymer deposited on the shell surface through the graft-polymerization is stably fixed on the shell surface and advantageously covers the shell surface to give to the toner uniform electron-chargeability.

Otherwise, the polymer can be deposited over the shell surface by coating a solution or dispersion of the separately-prepared polymer.

The polymer of a vinyl monomer preferably has a polymerization degree in the range of 20 to 2,000.

The polymer of a vinyl monomer having a nitrogen atom is deposited on the surface of the shell preferably in an amount of 0.1 to 20 parts by weight based on 100 parts by weight of the toner.

Examples of the vinyl monomer having the aforementioned formula (I) include:
N,N-dimethylaminoethylmethacrylate;
N,N-diethylaminoethylmethacrylate;
N-methylaminoethylmethacrylate;
N,N-diethylaminomethylmethacrylate;
p-N,N-diethylaminophenylmethacrylate;
N,N-dimethylaminoethylacrylate;
N,N-diethylaminoethylacrylate;
N-methylaminoethylacrylate;
N,N-diethylaminomethylacrylate; and
p-N,N-dimethylaminophenylacrylate.

Examples of the vinyl monomer having the aforementioned formula (II) include:
N,N-dimethylaminoethylmethacrylamide;
N,N-diethylaminoethylmethacrylamide;
N,N-dimethylaminomethylmethacrylamide;
N,N-diethylaminomethylmethacrylamide;
N-methylaminoethylmethacrylamide;
p-N,N-dimethylaminophenylmethacrylamide;
N,N-dimethylaminoethylacrylamide;
N,N-diethylaminoethylacrylamide;
N,N-dimethylaminomethylacrylamide;
N,N-diethylaminomethylacrylamide;
N-methylaminoethylacrylamide; and
p-N,N-dimethylaminophenylacrylamide.

Examples of the vinyl monomer having the aforementioned formula (III) include:
N,N-dimethylmethacrylamide;
N,N-diethylmethacrylamide;
N-propylmethacrylamide;
N,N-dimethylacrylamide;
N,N-diethylacrylamide; and
N-propylacrylamide.

Examples of the vinyl monomer having the aforementioned formula (IV) include:
p-N,N-dimethylaminostyrene;
m-N,N-diethylaminostyrene;
p-N,N-dipropylaminostyrene; and
p-N-methylaminostyrene.

Examples of the vinyl monomer having the aforementioned formula (V) include:
N-vinyldimethylamine;
N-vinyldiethylamine;
N-vinyldipropylamine; and
N-vinylpropylamine.

Examples of the vinyl monomer having the aforementioned formula (VI) include:
methyl acrylate;
methyl methacrylate;
ethyl acrylate;
ethyl methacrylate; propyl acrylate; and
propyl methacrylate.

Examples of the vinyl monomers having the aforementioned formula (VII) include:
N-vinylimidazole;
2-vinylimidazole;
4-vinylimidazole;
N-vinyl-2-methylimidazole;
N-vinyl-2,4-dimethylimidazole;
N-vinyl-2-ethylimidazole;
N-vinyl-2,4-diethylimidazole; and
N-vinyl-2-propylimidazole;

Examples of the vinyl monomer having the aforementioned formula (VIII) include:
2-vinylpyridine;
5-methyl-2-vinylpyridine;
5-ethyl-2-vinylpyridine;
4,5-dimethyl-2-vinylpyridine;
4-vinylpyridine; and
2-methyl-4-vinylpyrizine.

Examples of the vinyl monomer having the aforementioned formula (IX) include:
diethylaminomethylstyrene;
dibutylaminomethylstyrene;
dihexylaminomethylstyrene;
dimethylaminoethylstyrene;
diethylaminomethylstyrene; and
methylethylaminomethylstyrene.

As stated hereinbefore, the polymer of the vinyl monomer employable for the deposition on the surface of the encapsulated toner of the invention preferably has polymerization degree within the range of 20–2,000, more preferably within the range of 100–500. The amount of the vinyl monomer is preferably within the range of 0.1–20 wt%, more preferably 0.5–5 wt.%, per 100 wt.% of the encapsulated toner.

As a method of subjecting a polymer derived from the vinyl monomer to deposition on the surface of the encapsulated toner, various methods can be employed. Preferred is a method of grafting the vinyl monomer on the surface of the encapsulated toner. Examples of the grafting methods preferably employable in the invention include a method of redox polymerization comprising using Ce(IV), namely tetravalent cerium, as a catalyst to perform polymerization reaction on the toner surface, and a method comprising a procedure of graft polymerization of a divinyl monomer by using Ce(IV) and a procedure of radical polymerization of the vinyl monomer of the invention by using a radical polymerization initiator (e.g., peroxide and azo compound) or a redox polymerization initiator (e.g., combination of peroxide and reducing agent).

The tetravalent cerium is generally employed in the form of a compound containing Ce(IV). Examples of the tetravalent cerium-containing compounds include cerium ammnium sulfate and cerium ammonium nitrate.

In the graft-polymeziation reaction, the tetravalent cerium compound is generally employed in an amount of 0.05 to 0.0005 mole, preferably 0.05 to 0.01 mole, per one mole of the vinyl monomer or other reactive monomer. The polymerization reaction is generally performed at room temperature or with heating, advantageously in the presence of dilute nitric acid, and advantageously in the absence of oxygen. The reaction period generally is from 0.1 to 5 hours.

Details of the graft polymerization using Ce(IV) is described in "GRAFT POLYMERIZATION AND APPLICATION THEREOF" by Ide Fumio (Polymer Publishing Association).

Examples of the radical polymerization initiator include $H_2O_2$, $K_2S_2O_8$, $(NH_4)_2S_2O_8$, alkyl hydroperoxide, dialkyl peroxide, diacyl peroxide, peracid ester and azo compounds. Examples of the redox polymerization initiator include combinations of peroxide such as persulfate, hydrogen peroxide or hydroperoxide and various reducing agents. For instance, those combinations are hydrogen peroxide and ferrous salt; benzoyl peroxide and dimethylaniline; and $K_2S_2O_8$ and $NaHSO_3$.

In the preparation of the encapsulated toner of the invention, other methods than the above-described ones can be employed for the deposition of a polymer of the vinyl monomer on the surface of the encapsulated toner. For instance, in a solution of the polymer derived from vinyl monomer or in a dispersion thereof are dispersed encapsulated toner particles, and the obtained dispersion is dried by a spray drying.

The encapsulated toner of the invention can be provided on its surface with an electrostatic charge modifier, which is conventionally employed, such as silica powder, alumina powder or titanium powder.

The examples and the comparison example of the present invention are given below.

EXAMPLE 1

40 g. of 1-isopropyl-phenyl-2-phenylethane solution containing 20 wt.% of polyisobutylmethacrylate (trade name: Acrybase, MM-2002-2; available from Fujikura Kasei Co., Ltd.) and 10 wt.% of polyisobutylmethacrylate (trade name: Acrybase, MM-2002-1; available from Fujikura Kasei Co., Ltd.) was mixed with 70 g. of magnetite particles (trade name: EPT-1000, available from Toda Industry Co., Ltd.) in an automatic mortar, to prepare a dispersion (magnetizable ink).

Separately, in 60 g. of ethyl acetate were dissolved 20 g. of paraffinic oil having a boiling point of 170°–190° C., 3 g. of dimethylphenylsiloxane (trade name: Silicone KF50, 3000 cs, available from Shinetsu Chemical Industry Co., Ltd.), 10 g. of an addition product of 3 mols of hexamethylenediisocyanate and 1 mol of trimethylolpropane (trade name: Barnoc D-950, available from Dainippon Ink & Chemicals Inc.,), and 10 g. of an addition product of 3 mols of toluylene diisocyanate and 1 mol of trimethylolpropane (trade name: Barnoc D-750, available from Dainippon Ink & Chemicals Inc.,), to prepare a solution. The solution and the above-obtained dispersion (magnetizable ink) were mixed together to prepare an oil-phase mixture liquid. The oil-phase mixture liquid (a mixture of core material and shell material) was prepared by setting the temperature of the liquid to 25° C.

Independently, to 200 g. of a 4 wt% solution of methyl cellulose (methoxy group substitution degree: 1.8, mean molecular weight: 15,000) was added 0.2 g. of diethylenetriamine, to prepare an aqueous medium. The aqueous medium was cooled to 15° C.

In the aqueous medium was dispersed the above-prepared oil-phase mixture liquid to produce an oil-in-water emulsion containing droplets having average diameter of approx. 12 μm.

In approx. 10 minutes after the preparation of the emulsion, 50 g. of a 2.5 wt.% solution of diethylene triamine was dropped little by little in the emulsion, and the emulsion was stirred for 3 hours in a constant temperature bath at 60° C., to complete the encapsulation. Thus obtained micro-capsule dispersion was subjected to centrifugal separation at 5,000 rpm so as to separate the micro-capsules from the aqueous solution containing methyl cellulose (supernatant liquid). The obtained micro-capsule slurry was dispersed in water to prepare a 30 wt.% dispersion. The dispersion was further subjected tp another washing procedure comprising centrifugal separation and dispersing in water, to prepare a micro-capsule slurry. To the micro-capsule slurry was again added 450 g. of water to obtain a dispersion containing micro-capsules.

To the dispersion were added 12.5 g. of 1-N nitric acid, 1.1 g. (0.006 mol) of ethylene glycol dimethacrylate and 0.75 g. (0.00125 mol) of cerium ammonium nitrate, and they were stirred at room temperature for 3 hours so as to graft-polymerize the ethylene glycol dimethacrylate on the surface of the micro-capsule. Subsequently, the micro-capsule dispersion was subjected three times to washing procedures comprising centrifugal separation and dispersing in water, to obtain a slurry containing micro-capsules.

To the slurry were successively added 450 g. of water, 0.4 g. (0.0015 mol) of potassium persulfate, 0.16 g. (0.0015 mol) of sodium sulfite, and 4 g. (0.022 mol) of N,N-diethylaminoethyl methacrylate, and they were stirred at room temperature for 3 hours so as to graft polymerize the N,N-diethylaminoethyl methacrylate on the surface of micro-capsule.

The obtained micro-capsule dispersion was washed with water at 15 times by decantation, and then hydrophobic silica (RA-200H, available from Japan Aerogil Co., Ltd.) was added to the dispersion in such a manner that the amount of hydrophobic silica would be 0.5% by weight of the toner particles. The dispersion containing the hydrophobic silica was dried at 60° C. in an oven to obtain encapsulated toner particles. The binder composition of the encapsulated toner having been independently prepared was measured on the viscosity. The viscosity was 25,000 cp at 25° C.

The obtained encapsulated toner particles were mixed with iron powder carriers (DSP-132, available from Dowa Iron Powder Industry Co., Ltd.), and the mixture was measured on the blow-off electrostatic charge. The blow-off electrostatic charge was +7 μq/g.

Subsequently, using the encapsulated toner, a latent image having negative electrostatic charge produced by conventional electrostatography was developed through a magnetic blushing method. The obtained visible toner image was then transferred onto an ordinary paper sheet and fixed onto the paper sheet at a pressure of 150 kg/cm$^2$.

Thus fixed visible image had high sharpness and no fog. Further, even a visible image written with a pencil can be sharply duplicated using the encapsulated toner.

The visible image fixed onto the paper sheet was rubbed with a finger in 15 minutes after fixing, and no stain of the image was observed.

Then the visible image was evaluated on the durability by the test of continuous duplication of 20,000 times in a commercially available duplicating machine. Even after the continuous duplication of 20,000 times, the density of visible image hardly decreased. Further, the continuous duplication test of 30,000 times was carried out on the visible image, and substantial decrease of image density was not observed.

EXAMPLE 2

The procedure of Example 1 was repeated except for using 4.2 g. (0.022 mol) of p-N,N-dimethylaminophenyl acrylate instead of 4 g. of N,N-diethylaminoethyl methacrylate, to prepare an encapsulated toner.

The electrostatic charge of the encapsulated toner was measured in the same manner as described in Example 1. The electrostatic charge was +10 μq/g.

Using the encapsulated toner, a latent image having negative electrostatic charge produced by conventional electrostatography was developed through a magnetic blushing method. The obtained visible toner image was then transferred onto an ordinary paper sheet and fixed onto the paper sheet at a pressure of 150 kg/cm$^2$.

Thus fixed visible image had high sharpness and no fog. Further, even a visible image written with a pencil can be sharply duplicated using the encapsulated toner.

The visible image fixed onto the paper sheet was rubbed with a finger in 15 minutes after fixing, and no stain of the image was observed.

Then the visible image was evaluated on the durability by the test of continuous duplication of 20,000 times. Even after the continuous duplication of 20,000 times, the density of visible image hardly decreased. Further, the continuous duplication test of 30,000 times was carried out on the visible image, and substantial decrease of image density was not observed.

EXAMPLE 3

The procedure of Example 1 was repeated except for using 18.6 g. (0.1 mol) of N,N-diethylaminopropyl acrylamide instead of 4 g. of N,N-diethylaminoethyl methacrylate, to prepare an encapsulated toner.

The electrostatic charge of the encapsulated toner was measured in the same manner as described in Example 1. The electrostatic charge was +5 μq/g.

Using the encapsulated toner, a latent image having negative electrostatic charge produced by conventional electrostatography was developed through a magnetic blushing method. The obtained visible toner image was then transferred onto an ordinary paper sheet and fixed onto the paper sheet at a pressure of 150 kg/cm$^2$.

Thus fixed visible image had high sharpness and no fog. Further, even a visible image written with a pencil can be sharply duplicated using the encapsulated toner.

The visible image fixed onto the paper sheet was rubbed with a finger in 15 minutes after fixing, and no stain of the image was observed.

Then the visible image was evaluated on the durability by the test of continuous duplication of 20,000 times. Even after the continuous duplication of 20,000 times, the density of visible image hardly decreased. Further, the continuous duplication test of 30,000 times was carried out on the visible image, and substantial decrease of image density was not observed.

EXAMPLE 4

The procedure of Example 1 was repeated except for using 19.8 g. (0.2 mol) of N,N-dimethylacrylamide instead of 4 g. of N,N-diethylaminoethyl methacrylate, to prepare an encapsulated toner.

The electrostatic charge of the encapsulated toner was measured in the same manner as described in Example 1. The electrostatic charge was +4 μq/g.

Using the encapsulated toner, a latent image having negative electric charge produced by conventional electrostatography was developed through a magnetic blushing method. The obtained visible toner image was then transferred onto an ordinary paper and fixed onto the paper sheet at a pressure of 150 kg/cm$^2$.

Thus fixed visible image had high sharpness and no fog. Further, even a visible image written with a pencil can be sharply duplicated using the encapsulated toner.

The visible image fixed onto the paper sheet was rubbed with a finger in 15 minutes after fixing, and no stain of the image was observed.

Then the visible image was evaluated on the durability by the test of continuous duplication of 20,000 times. Even after the continuous duplication of 20,000 times, the density of visible image hardly decreased. Further, the continuous duplication test of 30,000times was carried out on the visible image, and substantial decrease of image density was not observed.

EXAMPLE 5

The procedure of Example 1 was repeated except for using 1.5 g. (0.01 mol) of p-N,N-dimethylacrylamino styrene instead of 4 g. of N,N-diethylaminoethyl methacrylate, to prepare an encapsulated toner.

The electrostatic charge of the encapsulated toner was measured in the same manner as described in Example 1. The electrostatic charge was +8 μq/g.

Using the encapsulated toner, a latent image having negative electric charge produced by conventional electrostatography was developed through a magnetic blushing method. The obtained visible toner image was then transferred onto an ordinary paper sheet and fixed onto the paper sheet a pressure of 150 kg/cm$^2$.

Thus fixed visible image had high sharpness and no fog. Further, even a visible image written with a pencil can be sharply duplicated using the encapsulated toner.

The visible image fixed onto the paper was rubbed with a finger in 15 minutes after fixing, and no stain of the image was observed.

Then the visible image was evaluated on the durability by the test of continuous duplication of 20,000 times. Even after the continuous duplication of 20,000 times, the density of visible image hardly decreased. Further, the continuous duplication test of 30,000 times was carried out on the visible image, and substantial decrease of image density was not observed.

EXAMPLE 6

The procedure of Example 1 was repeated except for using 12.2 g. (0.1 mol) of N-vinyl-2,4-dimethylimidazole instead of 4 g. of N,N-diethylaminoethyl methacrylate, to prepare an encapsulated toner.

The electrostatic charge of the encapsulated toner was measured in the same manner as described in Example 1. The electrostatic charge was +6 μq/g.

Using the encapsulated toner, a latent image having negative electric charge produced by conventional electrostatography was developed through a magnetic blushing method. The obtained visible toner image was then transferred onto an ordinary paper sheet and fixed onto the paper sheet at a pressure of 150 kg/cm$^2$.

Thus fixed visible image had high sharpness and no fog. Further, even a visible image written with a pencil can be sharply duplicated using the encapsulated toner.

The visible image fixed onto the paper sheet was rubbed with a finger in 15 minutes after fixing, and no stain of the image was observed.

Then the visible image was evaluated on the durability by the test of continuous duplication of 20,000 times. Even after the continuous duplication of 20,000 times, the density of visible image hardly decreased. Further, the continuous duplication test of 30,000 times was carried out on the visible image, and substantial decrease of image density was not observed.

EXAMPLE 7

The procedure of Example 1 was repeated except for using 23.8 g. (0.2 mol) of 5-methyl-2-vinylpyridine instead of 4 g. of N,N-diethylaminoethyl methacrylate, to prepare an encapsulated toner.

The electrostatic charge of the encapsulated toner was measured in the same manner as described in Example 1. The electrostatic charge was +9 μq/g.

Using the encapsulated toner, a latent image having negative electric charge produced by conventional electrostatography was developed through a magnetic blushing method. The obtained visible toner image was then transferred onto an ordinary paper sheet and fixed onto the paper sheet at a pressure of 150 kg/cm$^2$.

Thus fixed visible image had high sharpness and no fog. Further, even a visible image written with a pencil can be sharply duplicated using the encapsulated toner.

The visible image fixed onto the paper sheet was rubbed with a finger in 15 minutes after fixing, and no stain of the image was observed.

Then the visible image was evaluated on the durability by the test of continuous duplication of 20,000 times. Even after the continuous duplication of 20,000 times, the density of visible image hardly decreased. Further, the continuous duplication test of 30,000 times was carried out on the visible image, and substantial decrease of image density was not observed.

EXAMPLE 8

The procedure of Example 1 was repeated except for using 5.2 g. (0.22 mol) of N,N-dibutylaminomethylstyrene instead of 4 g. of N,N-diethylaminoethylmethacrylate, to prepare an encapsulated toner.

The electrostatic charge of the encapsulated toner was measured in the same manner as described in Example 1. The electrostatic charge was +7 μq/g.

Using the encapsulated toner, a latent image having negative electric charge produced by conventional electrostatography was developed through a magnetic blushing method. The obtained visible toner image was then transferred onto an ordinary paper sheet and fixed onto the paper sheet at a pressure of 150 kg/cm$^2$.

Thus fixed visible image had high sharpness and no fog. Further, even a visible image written with a pencil can be sharply duplicated using the encapsulated toner.

The visible image fixed onto the paper sheet was rubbed with a finger in 15 minutes after fixing, and no stain of the image was observed.

Then the visible image was evaluated on the durability by the test of continuous duplication of 20,000 times. Even after the continuous duplication of 20,000 times, the density of visible image hardly decreased. Further, the continuous duplication test of 30,000 times was carried out on the visible image, and substantial decrease of image density was not observed.

EXAMPLE 9

The procedure of Example 1 was repeated except for using a combination of 0.8 g. (0.0044 mol) of N,N-diethylaminoethyl methacrylate and 1.6 g. (0.016 mol) of methyl methacrylate instead of 4 g. of N,N-diethylaminoethyl methacrylate, to prepare an encapsulated toner having a grafted copolymer deposited on the shell surface.

The electrostatic charge of the encapsulated toner was measured in the same manner as described in Example 1. The electrostatic charge was +10 μq/g.

Using the encapsulated toner, a latent image having negative electric charge produced by conventional electrostatography was developed through a magnetic blushing method. The obtained visible toner image was then transferred onto an ordinary paper sheet and fixed onto the paper sheet at a pressure of 150 kg/cm$^2$.

Thus fixed visible image had high sharpness and no fog. Further, even a visible image written with a pencil can be sharply duplicated using the encapsulated toner.

The visible image fixed onto the paper sheet was rubbed with a finger in 15 minutes after fixing, and no stain of the image was observed.

Then the visible image was evaluated on the durability by the test of continuous duplication of 20,000 times. Even after the continuous duplication of 20,000 times, the density of visible image hardly decreased. Further, the continuous duplication test of 30,000 times was carried out on the visible image, and substantial decrease of image density was not observed.

COMPARISON EXAMPLE 1

The procedure of Example 1 was repeated except that graft-polymerization of ethylene glycol dimethacrylate and N,N-diethylaminoethylmethacrylate on the surface of micro-capsules and washing procedure were not carried out and that the micro-capsule dispersion was mixed with 2 wt.% of hydrophobic silica (RA-200H, available from Japan Aerogil Co., Ltd.), to prepare an encapsulated toner.

The electrostatic charge of the encapsulated toner was measured in the same manner as described in Example 1. The electrostatic charge was +0.5 μq/g.

Using the encapsulated toner, a latent image having negative electric charge produced by conventional electrostatography was developed through a magnetic blushing method. The obtained visible toner image was then transferred onto an ordinary paper sheet and fixed onto the paper sheet at a pressure of 150 kg/cm$^2$.

The density of thus fixed visible image was extremely low, and it was impossible to practically use the visible image for duplication.

EXAMPLE 10

To the micro-capsule dispersion obtained in the same manner as in Example 1 were added 5 g. of 1-N nitric acid, 10 g. (0.19 mol) of acrylonitrile and 0.3 g. (0.0005 mol) of cerium ammonium nitrate, and they were stirred at room temperature for 3 hours so as to graft-polymerize acrylonitrile on the surface of the microcapsule. Subsequently, the micro-capsule dispersion was subjected three times to washing procedures comprising centrifugal separation and dispersing in water, and then dried in an oven at 60° C. to obtain a toner in the form of micro-capsules on which polyacrylonitrile was grafted.

Subsequently, using the encapsulated toner, a latent image having positive electrostatic charge produced by conventional electrostatography was developed through a magnetic blushing method. The obtained visible toner image was then transferred onto an ordinary paper sheet and fixed onto the paper sheet at a pressure of 150 kg/cm$^2$.

Thus fixed visible image had high sharpness and no fog. Further, even a visible image written with a pencil can be sharply duplicated using the encapsulated toner.

The visible image fixed onto the paper sheet was rubbed with a finger in 15 minutes after fixing, and no stain of the image was observed.

Then the visible image was evaluated on the durability by the test of continuous duplication of 20,000 times in a commercially available duplicating machine. Even after the continuous duplication of 20,000 times, the density of visible image hardly decreased. Further, the continuous duplication test of 30,000 times was carried out on the visible image, and substantial decrease of image density was not observed.

It was further confirmed that the encapsulated toner of this example gave a sharp toner image after one-mont storage at high temperature (35° C.) and high relative humidity (90%RH).

EXAMPLE 11

The dispersion of micro-capsules prepared in the same manner as in Example 1 was subjected to filtration to separate the micro-capsules from the aqueous medium.

Thus collected microcapsules (50 g.) were suspended in 95 g. of a dimethylsulfoxide solution containing 1 wt.% of polyacrylonitrile (polymerization degree: 100). 100 g. of the resulting dispersion was mixed with 1,000 g. of distilled water under stirring. Then, the mixture was allowed to stand for 1 hour to deposit the micro-capsules. Subsequently, 1,000 g. of the supernatant was removed by decantation. Then, the residual micro-capsule slurry was mixed with 1,000 g. of distilled water under stirring, and the resulting micro-capsule dispersion was spray-dried to obtain a dry toner.

Subsequently, using the encapsulated toner, a latent image having positive electrostatic charge produced by conventional electrostatography was developed through a magnetic blushing method. The obtained visible toner image was then transferred onto an ordinary paper sheet and fixed onto the paper sheet at a pressure of 150 kg/cm$^2$.

Thus fixed visible image had high sharpness and no fog. Further, even a visible image written with a pencil can be sharply duplicated using the encapsulated toner.

The visible image fixed onto the paper sheet was rubbed with a finger in 15 minutes after fixing, and no stain of the image was observed.

Then the visible image was evaluated on the durability by the test of continuous duplication of 20,000 times. Even after the continuous duplication of 20,000 times, the density of visible image hardly decreased. Further, the continuous duplication test of 30,000 times was carried out on the visible image, and substantial decrease of image density was not observed.

It was further confirmed that the encapsulated toner of this example gave a sharp toner image after one-mont storage at high temperature (35° C.) and high relative humidity (90%RH).

We claim:

1. An electrostatographic encapsulated toner comprising a core material which comprises a colorant and a binder and a resin shell enclosing said core material in the form of a micro-capsule, which is characterized in that said binder is an oily binder comprising a solid polymer and an organic solvent capable of dissolving or swelling said polymer and having a boiling point of not lower than 150° C., said oily binder having a viscosity within the range of 1,000–100,000 cp at 25° C.;

said resin shell formed around the core material being selected from the group consisting of resin shells formed from interfacial polymerization, inner polymerization, and outer polymerization processes; and the surface of said resin shell is deposited with a polymer of at least one vinyl monomer which is selected from the group consisting of acrylonitrile, and

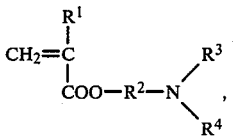
(I)

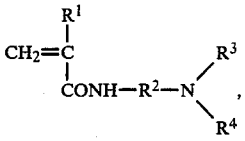
(II)

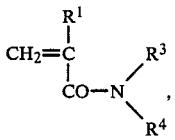
(III)

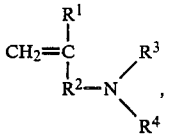
(IV)

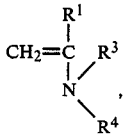
(V)

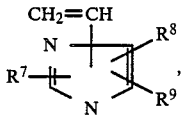
(VII)

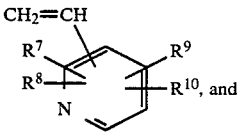
(VIII)

-continued

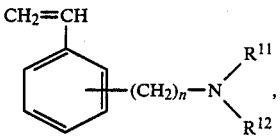
(IX)

in which $R^1$ is the hydrogen atom or an alkyl group having 1–4 carbon atoms;

$R^2$ is selected from the group consisting of an alkylene group having 1–8 carbon atoms, an alkylene oxyalkylene group having 1–8 carbon atoms, a phenylene group, a naphthylene group and a group having a combination of two or more of those groups;

$R^3$ and $R^4$ are the same as or different from each other, each of $R^3$ and $R^4$ is the hydrogen atom or a group selected from the group consisting of an alkyl group having 1–8 carbon atoms, a phenyl group, a naphthyl group and a phenylalkyl group having an alkyl group of 1–4 carbon atoms;

$R^7$, $R^8$, $R^9$ and $R^{10}$ are the same as or different from each other and each is the hydrogen atom or an alkyl group having 1–10 carbon atoms; and $R^{11}$ and $R^{12}$ are the same as or different from each other and each is the hydrogen atom or a group selected from the group consisting of an alkyl group having 1–10 carbon atoms, a phenyl group, a naphthyl group and a phenylalkyl group having 1–4 carbon atoms in the alkyl chain; and n is an integer of 1 to 4;

said vinyl monomer having been graft-polymerized on the surface of the shell.

2. The electrostatographic encapsulated toner as claimed in claim 1 wherein the vinyl monomer has been graft-polymerized on the surface of the shell in the presence of a tetravalent cerium compound.

3. The electrostatographic encapsulated toner as claimed in claim 1 wherein the polymer of a vinyl monomer is deposited on the surface of the shell in an amount of 0.1 to 20 parts by weight based on 100 parts by weight of the toner.

4. The electrostatographic encapsulated toner as claimed in claim 1 wherein the polymer of a vinyl monomer has a polymerization degree in the range of 20 to 2,000.

5. The electrostatographic encapsulated toner as claimed in claim 1 wherein said shell comprises at least one resin selected from the group consisting of polyurea resin and polyurethane resin.

6. An electrostatographic encapsulated toner comprising a core material which comprises a colorant and a binder and a resin shell enclosing said core material in the form of a micro-capsule, which is characterized in that:

said binder is an oily binder comprising a solid polymer and an organic solvent capable of dissolving or swelling said polymer and having a boiling point of not lower than 150° C., said oily binder having a viscosity within the range of 1,000–100,000 cp at 25° C.;

said resin shell formed around the core material being selected from the group consisting of resin shells formed from interfacial polymerization, inner polymerization, and outer polymerization processes; and the surface of said resin shell is deposited with a copolymer of a monomer selected from the group consisting of:

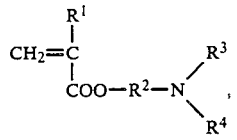
(I)

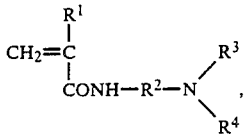
(II)

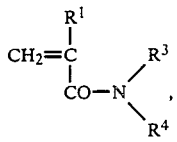
(III)

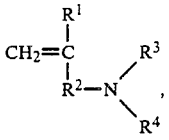
(IV)

and

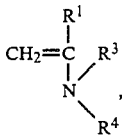
(V)

in which $R^1$ is the hydrogen atom or an alkyl group having 1–4 carbon atoms;

$R^2$ is one selected from the group consisting of an alkylene group having 1–8 carbon atoms, an alkylene oxyalkylene group having 1–8 carbon atoms, a phenylene group, a naphthylene group and a group having a combination of two or more of those groups;

$R^3$ and $R^4$ are the same as or different from each other, and each $R^3$ and $R^4$ is the hydrogen atom or a group selected from the group consisting of an alkyl group having 1–8 carbon atoms, a phenyl group, a naphthyl group and a phenylalkyl group having an alkyl group of 1–4 carbon atoms, and a vinyl monomer having the formula

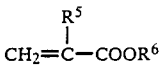
(VI)

wherein $R^5$ is the hydrogen atom or an alkyl group having 1–4 carbon atoms, and $R^6$ is the hydrogen atom or a group selected from the group consisting of an alkyl group having 1–8 carbon atoms, a phenyl group, a naphthyl group and a phenylalkyl group having an alkyl group of 1–4 carbon atoms, said vinyl monomer having been graft-polymerized on the surface of the shell.

7. The electrostatographic encapsulated toner as claimed in claim 6 wherein the vinyl monomer has been graft-polymerized on the surface of the shell in the presence of a tetravalent cerium compound.

8. The electrostatographic encapsulated toner as claimed in claim 6 wherein the copolymer of a vinyl monomer having a nitrogen atom is deposited on the surface of the shell in an amount of 0.1 to 20 parts by weight based on 100 parts by weight of the toner.

9. The electrostatographic encapsulated toner as claimed in claim 6 wherein the copolymer of a vinyl monomer has a polymerization degree in the range of 20 to 2,000.

10. The electrostatographic encapsulated toner as claimed in claim 6 wherein said shell comprises at least one resin selected from the group consisting of polyurea resin and polyurethane resin.

11. An electrostatographic encapsulated toner comprising a core material which comprises a colorant and a binder and a resin shell enclosing said core material in the form of a micro-capsule, which is characterized in that:

said binder is an oily binder comprising a solid polymer and an organic solvent capable of dissolving or swelling said polymer and having a boiling point of not lower than 150° C., said oily binder having a viscosity within the range of 1,000–100,000 cp at 25° C.;

said resin shell comprises polyurea or polyurethane and has been formed around the core material by interfacial polymerization, inner polymerization, or outer polymerization processes; and the surface of said resin shell is deposited with polyacrylonitrile.

12. The electrostatographic encapsulated toner as claimed in claim 11 wherein the polyacrylonitrile is deposited on the surface of the shell in an amount of 0.1 to 20 parts by weight based on 100 parts by weight of the toner.

13. The electrostatographic encapsulated toner as claimed in claim 11 wherein the polyacrylonitrile has a polymerization degree in the range of 20 to 2,000.

* * * * *